United States Patent [19]

Matthews

[11] 4,077,762

[45] Mar. 7, 1978

[54] FUEL IGNITION SYSTEM HAVING CONTACT INTERLOCK PROTECTION

[75] Inventor: Russell Byron Matthews, Goshen, Ind.

[73] Assignee: Johnson Controls, Inc., Milwaukee, Wis.

[21] Appl. No.: 698,162

[22] Filed: Jun. 21, 1976

[51] Int. Cl.[2] ..... F23Q 9/08; F23Q 23/00

[52] U.S. Cl. ..... 431/45; 431/43; 431/25

[58] Field of Search ..... 431/26, 45, 42, 43, 431/25, 28

[56] References Cited

U.S. PATENT DOCUMENTS

| | | | |
|---|---|---|---|
| 2,989,117 | 6/1961 | Graves | 431/45 X |
| 3,376,099 | 4/1968 | Giuffrida | 431/45 X |
| 3,501,253 | 3/1970 | Wade | 431/43 |
| 3,902,839 | 9/1975 | Matthews | 431/25 |

*Primary Examiner*—William F. O'Dea
*Assistant Examiner*—Larry Jones
*Attorney, Agent, or Firm*—Emrich, Root, O'Keeffe & Lee

[57] ABSTRACT

A control arrangement for a fuel ignition system for providing an interlock on start-up to prevent the energization of fuel valves of the system under certain failure conditions includes a switching device which is energized over normally closed contacts of a flame relay to close associated contacts to prepare an energizing path for a pilot valve and to energize an interlock relay which completes the energizing path for the pilot valve, a main valve being energized and the switching device being deenergized to interrupt the energizing path when the flame relay is operated in response to the establishing of a pilot flame, and the pilot valve and the main valve being maintained energized over a holding path provided by the interlock relay, the energization of the pilot valve and the interlock relay being prevented whenever the normally closed contacts of the flame relay are open on start-up. In a second embodiment, the pilot valve and the interlock relay are energized directly over normally closed contacts of the flame relay so that the system is maintained in a lock out condition whenever the normally closed contacts are open on start-up.

22 Claims, 5 Drawing Figures

FUEL IGNITION SYSTEM HAVING CONTACT INTERLOCK PROTECTION

BACKGROUND OF THE INVENTION

1. Field of the Invention

This invention relates to fuel ignition systems of the pilot ignition type and more particularly, to a control arrangement for use in such systems for providing an interlock on start-up under certain failure conditions.

2. Description of the Prior Art

In known fuel ignition systems of the pilot ignition type, a pilot valve is operated in response to the closure of thermostatically controlled contacts to supply fuel to a pilot outlet for ignition by a suitable igniter to establish a pilot flame. A pilot flame sensing circuit detects the pilot flame and effects the energization of a main valve which supplies fuel to a main burner apparatus for ignition by the pilot flame.

Typically, the operation of the main valve is controlled by a relay of the flame sensing circuit which has normally open contacts connected in the energizing path for the main valve to maintain the main valve deenergized until a pilot flame is established. When a pilot flame is established, the flame sensing circuit energizes the relay which closes its contacts to connect the main valve to an energizing circuit to permit the main valve to operate.

After the heating demand has been met, the thermostatically controlled contacts open to effect deenergization of the fuel valves to extinguish the flame. The flame sensing circuit responsively causes the relay to be deenergized, opening its contacts to disconnect the main valve from the energizing circuit in preparation for the next heating cycle. However, should the relay contacts which control the energization of the main valve become welded together following a successful ignition cycle, then, when the relay is deenergized, the main valve remains connected to the energizing circuit and will be energized when the thermostatically controlled contacts close in response to the next call for heat, even though a pilot flame is not established. Similarly, the main valve will also be connected to the energizing circuit for a circuit failure which permits the relay of the flame sensing circuit to be energized in the absence of a pilot flame. For such failure conditions, both the pilot valve and the main valve will be energized when the thermostatically controlled contacts close, permitting fuel to emanate from the pilot outlet and the main burner, an undesirable condition.

Various interlock arrangements have been proposed in the prior art, as exemplified by the U.S. Pat. Nos. 3,449,055 to J. C. Blackett, 3,644,074 to P. J. Cade and 3,709,783 to J. S. Warren, in which the energization of the fuel valves of the system is dependent upon the sequential operation of relays. In the systems disclosed in the patents referenced above, the energization of the pilot valve is effected in response to operation of a control relay which can be energized only if the flame relay is deenergized. Thereafter, the energization of the main valve is effected in response to the operation of a flame relay when a pilot flame is established, but only if the control relay is energized.

While under normal conditions the interlock circuits disclosed in these patents are effective to guard against the welded contact failure referred to above, the control relay and/or the flame relay may be energized inadvertantly following a failure of a solid state control device of the electronic circuits, permitting energization of the main valve in the absence of a pilot flame.

SUMMARY OF THE INVENTION

The present invention has provided a control arrangement for use in a fuel ignition system of the pilot ignition type which provides an interlock on start-up to prevent the energization of fuel valves of the system under certain failure conditions. In accordance with the invention, when the system is activated, a pilot valve means of the system is energized over an energizing path provided by a control means and is maintained energized over a holding path provided by a first switching means of the control means which is also energized over the energizing path. When the pilot valve means is energized, fuel is supplied to a pilot outlet for ignition to establish a pilot flame. A flame sensing means is responsive to the pilot flame to energize an associated second switching means to operate normally open contacts for connecting a main valve means of the system to the holding path for energization for supplying fuel to a main burner apparatus, and to interrupt the energizing path whereby the pilot valve means and the main valve means are maintained energized over the holding path.

When the system is activated, the pilot valve means and the first switching means are energized only if the second switching means is deenergized. Thus in the event of a failure in the flame sensing means which permits the second switching means to be maintained energized in the absence of a pilot flame, then when the system is activated, the energizing path is interrupted and the pilot valve means and the first switching means are not energized so that the system is maintained in a lock out condition. Similarly, in the event the contacts of the second switching means which control the operation of the main valve means become welded together, such condition prevents the enabling of the pilot valve means and the first switching means, and the system is maintained in a lock out condition.

Similarly, if the pilot valve seat develops a leak large enough to support flame at the pilot outlet and the thermostat contacts open to deenergize the system the pilot flame will continue to burn.

The presence of this flame will be detected by the sensing circuit and cause the second switching means to remain energized so that on the next call for heat, the system will not respond because the first switching means will remain deenergized.

Therefore, a leak in the pilot valve has the same effect as a welded contact, or other circuit failure that will keep the second switching means energized and cause the system to lock out.

In accordance with a disclosed embodiment, the control means includes a further switching means, embodied as a warp switch having normally open contacts and normally closed contacts connected in series in the energizing path, and heating element means which is energized when the system is activated to effect the closing of the normally open contacts to energize the first switching means, which is embodiied as a relay. Upon operation, the relay closes first contacts to connect the pilot valve means to the energizing path and closes second contacts, which are connected in shunt with the normally open contacts of the warp switch, to provide the holding path.

The second switching means includes a further relay having normally closed contacts connected in the energizing path for the heating element means of the warp switch, and normally open contacts connected in an energizing path for the main valve means. When a pilot flame is established, the flame sensing relay operates to open its normally closed contacts to deenergize the warp switch heater element means and to close its normally open contacts to energize the main valve means. Accordingly, the normally open contacts of the warp switch are opened and the pilot valve means and the main valve means are maintained energized over the holding path provided by the second contacts of the holding relay. In addition, the main valve means operates to supply fuel to the main burner apparatus. When a pilot flame fails to be established within a predetermined time period, the warp switch opens its normally closed contacts to interrupt the energizing path, deenergizing the pilot valve means and the holding relay and causing the system to be maintained in a lock out condition.

In the event of a failure in the flame sensing means which permits the flame sensing relay to be energized in the absence of a flame, or if the normally open contacts of the flame relay become welded together, then when the system is activated the next time, the energizing path for the heating element means of the warp switch is interrupted preventing closure of the normally open contacts of the warp switch thereby preventing the energization of the pilot valve means and the holding relay, maintaining the system in a lock out state.

In accordance with a further embodiment, the energizing path for the pilot valve means and the holding relay is provided over normally closed contacts of the flame relay and the holding relay is operable to close normally open contacts to provide a shunt path around the normally closed contacts of the flame sensing relay to establish the holding path. For the condition where the flame sensing relay is maintained energized in the absence of a pilot valve or if the normally open contacts of the flame sensing relay which control the operation of the main valve means are welded together, the normally closed contacts of the flame sensing relay are prevented from reclosing. Accordingly, the next time that the system is activated, the energizing path for the pilot valve means and the holding relay is interrupted and the system is maintained in a lock out condition.

DESCRIPTION OF PREFERRED EMBODIMENTS

Figure 1:
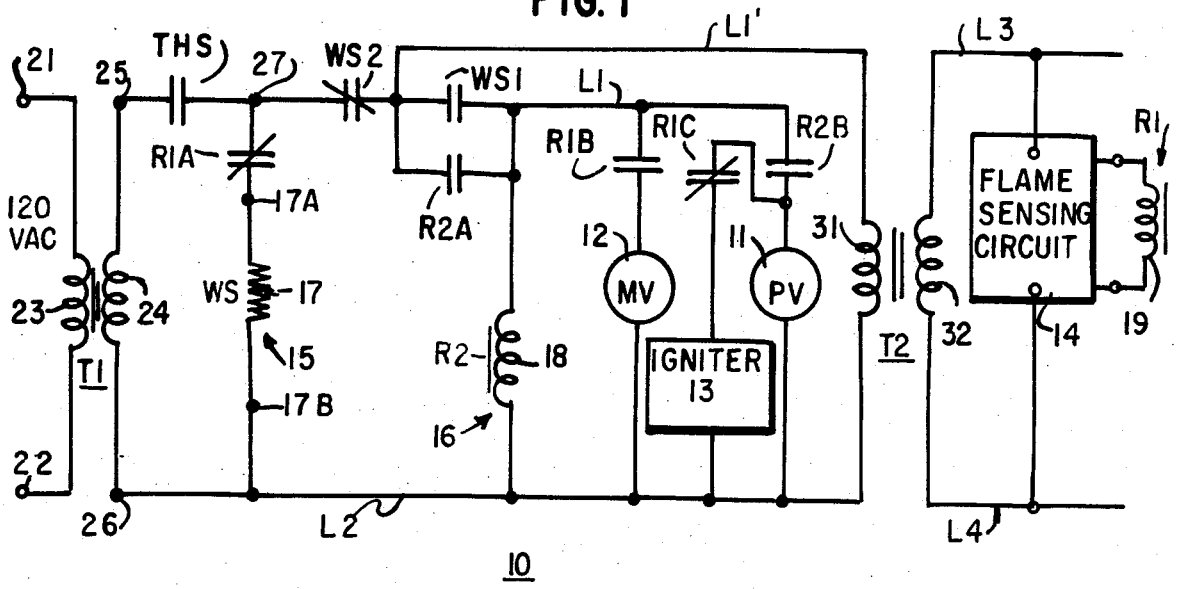
FIG. 1 is a schematic circuit diagram of a fuel ignition control system including a control arrangement provided in accordance with one embodiment of the invention.

Referring to FIG. 1, there is shown a simplified representation of a fuel ignition system 10 of the pilot ignition type which employs a control arrangement provided in accordance with one embodiment of the invention. The control arrangement includes a thermal switching device 15, embodied as a warp switch WS, and a switching device 16, embodied as a relay R2, which control the operation of a pilot valve 11, a main valve 12, an igniter 13 and a flame sensor 14 of the system 10. The heater 17 of the warp switch WS is energized over normally closed contacts R1A of a relay R1 of the flame sensing circuit 14 in response to operation of thermostatically controlled contacts THS to close normally open contacts WS1 to energize the pilot valve 11 and the igniter 13 after a predetermined time delay. The pilot valve 11 is operable when energized to supply fuel to a pilot outlet for ignition by ignition sparks provided by the igniter 13 to establish a pilot flame. The warp switch WS also effects energization of the relay R2 which closes contacts R2A to provide a holding path for the pilot valve 11 and the igniter 13.

The warp switch WS also effects energization of a flame sensing circuit 14 which responds to the pilot flame to effect the energization of a flame relay R1 which operates to close normally open contacts R1B permitting the main valve 12 to operate to supply fuel to a main burner apparatus for ignition by the pilot flame.

If a pilot flame fails to be established within a predetermined time, the warp switch WS opens contacts WS2 to interrupt the energizing path for the pilot valve 11 and the igniter 13 and the relay R2, thereby deenergizing the pilot valve 11 and preventing energization of the main valve 12.

In addition, in the event of a failure in the flame sensing circuit 14, such as a failure wherein contacts R1B which control the main valve 12 become welded together then, contacts R1A are prevented from closing when the flame sensing circuit 14 deenergizes the relay R1 following a heat run. Accordingly, the next time the thermostat contacts THS close to energize the system 10, the energizing path for the warp switch heater 17 is interrupted and the warp switch WS does not operate, maintaining the system 10 in lockout condition.

Considering the system 10 in more detail, power is supplied to the system over a step down transformer T1 which has a primary winding 23 connected to terminals 21 and 22 which are connected to a source of 120 V. The transformer T1 has a secondary winding 24 connected between terminals 25 and 26 to supply 25 VAC to terminals 25 and 26.

The warp switch heater element 17 is connected in a series circuit with normally closed contacts R1A of relay R1 of the flame sensing circuit 14 between point 27, which is connected over thermostatically controlled contacts THS to terminal 25 and a conductor L2 which is connected to terminal 26, to be energized whenever thermostatically controlled contacts THS close. The warp switch WS has normally closed contacts WS2 and normally open contacts WS1 connected in series between point 27 and a conductor L1 to provide an energizing path for the pilot valve 11, the main valve 12, the igniter 13 and the flame sensing circuit 14, and the operate coil 18 of relay R2.

The operate coil 18 of relay R2 is connected between conductors L1 and L2 and is energized, when warp switch WS operates to close warp switch contacts WS1, to close contacts R2A to provide a shunt path around contacts WS1 and to close contacts R2B which are connected in an energizing path for the pilot valve 11 and the igniter 13. The pilot valve 11 is connected in series with the normally open contacts R2B of relay R2 between conductors L1 and L2, permitting the pilot valve 11 to be energized whenever contacts R2B are closed. The igniter 13 is connected in series with normally closed contacts R1C of relay R1 in parallel with the pilot valve 11.

The flame sensing circuit 14, may be the type disclosed in U.S. Pat. No. 3,902,839 to R. B. Matthews, which was issued on Sept. 2, 1975. The operation of the flame sensing circuit is set forth in detail in the referenced patent.

Briefly, the flame sensing circuit 14 is energized in response to the closing of contacts THS which permits power to be supplied to conductors L3 and L4 over a secondary winding 32 of a transformer T2 which has a primary winding 31 connected between conductors L1' and L2. Conductor L1' is connected over warp switch contacts WS2 to terminal 27. The flame sensing circuit 14 is operable when energized to respond to the pilot flame to effect the energization of the operate coil 19 of relay R1. When relay R1 operates, normally open contacts R1B, which are connected in series with the main valve 12 between conductors L1 and L2, are closed, permitting the main valve 12 to operate to supply fuel to a main burner apparatus for ignition by the pilot flame. In addition, normally closed contacts R1A and R1C are opened deenergizing the warp switch heater 17 and the igniter 13.

Relay R1 is a double pole, double throw relay (DPDT) with contacts R1A and R1B employing a common armature of the relay R1 such that whenever contact R1B is closed, contact R1A is open. Also, should contact R1B become welded, contact R1A cannot reclose.

As indicated above, the thermal switching device 15 and the switching device 16 provide contact interlock on startup and total shutoff of fuel supply in the event of the failure condition noted above. The contact interlock is provided through the energization of relay R2, which comprises switching device 16, when the warp switch WS, which comprises the thermal switching device 15 operates to close contacts WS1. The relay R2 operates to close contacts R2A to provide a holding path for the pilot valve 11 and the main valve 12 when contacts WS1 of the warp switch WS are opened following the deenergization of the warp switch heater 17 by the flame relay R1 when the pilot flame has been established. In addition, in the event a pilot flame fails to be established within a predetermined time, the warp switch heater 17 is heated sufficiently to open normally closed contacts WS2 to deenergize the pilot valve shutting off fuel supply to the system.

Figure 2:
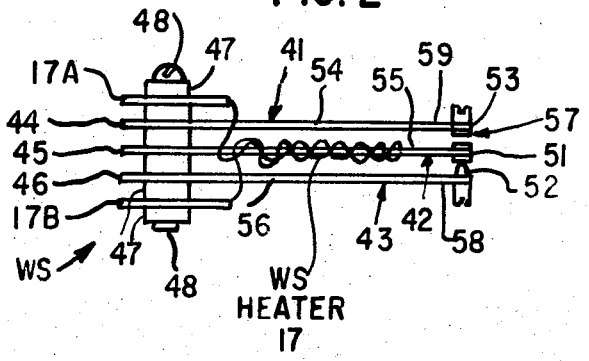
FIG. 2 is a side view of a warp switch assembly employed in the control arrangement of FIG. 1.

Referring to FIG. 2, in accordance with one embodiment, the thermal switching device 15 comprises a warp switch WS having a single heating element 17 which controls the operation of contacts WS1 and WS2.

As shown in FIG. 2, the warp switch WS comprises three cantilever mounted metallic spring members 41–43, with respective first ends 44–46 secured together in a stacked configuration with terminals 17A and 17B to which are connected the ends of the heating element 17, and respective main body portions 54–56 extending in a generally parallel spaced relation. Insulating members 47 are interposed between adjacent ends of the spring members 41–43, the ends 44–46 of which are held together by way of a suitable fastener 48.

Spring member 42, which is a bimetallic element, carries a movable contact 51 at the other end 57 which normally engages a fixed contact 52 carried by spring member 43 at end 58 thereof. Contacts 51 and 52 comprise normally closed contacts WS2 of the warp switch WS.

Spring member 41 carries a further contact 53 at end 59 thereof which is normally disengaged from movable contact 51, contacts 53 and 51 comprise normally open contact WS1 of the warp switch WS.

One end of the heating element 17, shown as a coil wound around the main body portion 55 of bimetallic member 42, intermediate ends 45 and 57, is connected to terminal 17A which is connectable to one side of contact R1A (FIG. 1). The other end of the coil 17 is connected to terminal 17B which is connectable to conductor L2.

When current is supplied to coil 17, the bimetallic member 42 is heated causing the member 42 to warp, moving contact 51 towards the end 59 of member 41 and into engagement with contact 53 to close contacts WS1 after a predetermined duration, which in the illustrative embodiment is ten seconds. Spring member 43 is spring biased to follow member 42 as it warps, permitting contact 52 to be maintained in engagement with movable contact 51 for a predetermined duration, which in the exemplary embodiment is thirty seconds, after which time contact 52 becomes disengaged from contact 51, opening contacts WS2.

When the heating element 17 is deenergized, the bimetallic element 42 cools causing end 57 to move contact 51 into engagement with contact 52 and out of engagement with contact 53.

Figure 2A:
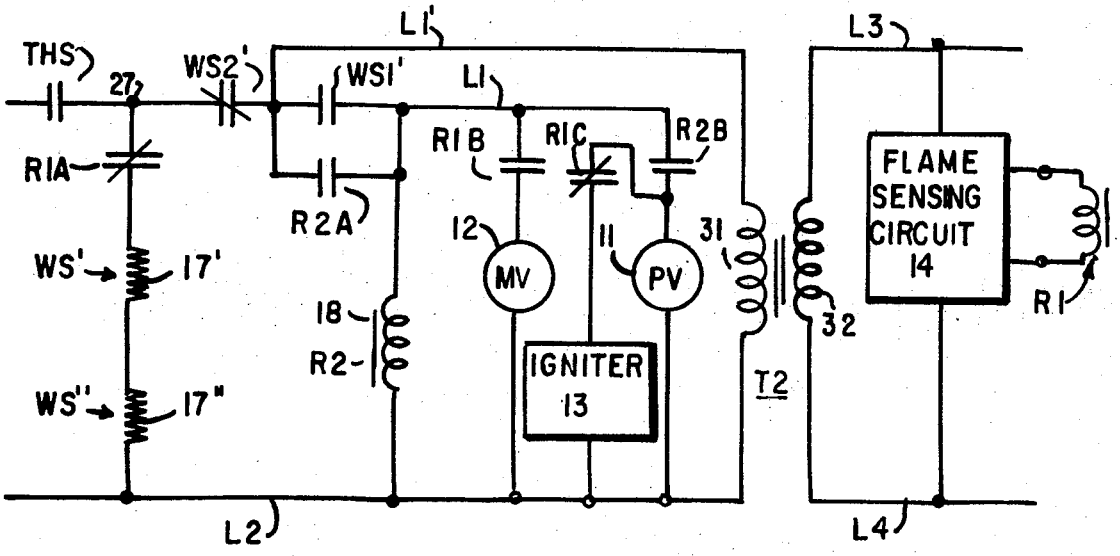
FIG. 2A is a schematic circuit diagram for a portion of the system of FIG. 1 illustrating an alternative warp switch assembly.

While in the exemplary embodiment the warp switch WS has a single heating element 17, two warp switches WS' and WS" may be employed as shown in FIG. 2A. Warp switch WS' has normally closed contacts WS2' which correspond to contacts WS2, and warp switch WS" has normally open contacts WS1' which correspond to contacts WS1. The heating elements 17' and 17" of warp switches WS' and WS" are connected in series with contacts R1A between point 27 and conductor L2.

Referring again to FIG. 1, in operation, in response to the closure of contacts THS, the warp switch heater 17 is energized over normally closed contacts R1A of relay R1, and the flame sensing circuit 14 is energized when power is supplied to transformer T2 over normally closed contacts WS2 of warp switch WS, and conductors L1' and L2. After a time interval of approximately 10 seconds, following closure of contacts THS, the heater element 17 has heated sufficiently to cause contacts WS1 to close to complete an energizing circuit for the pilot valve 11 and the igniter 13, and to complete an energizing circuit for relay R2 which then operates.

When relay R2 operates, a shunt path is provided around contacts WS1 by relay contacts R2A to provide a holding path for the operate coil 18 of the relay R2 and to maintain an energizing path for the pilot valve 11 and the igniter 13 when warp switch contacts WS1 open.

When the pilot valve 11 operates, fuel is supplied to the pilot outlet for ignition by sparks provided by the igniter 13. When a pilot flame is established, the flame sensing circuit 14 energizes the operate coil 19 of relay R1 which operates to open contacts R1A and R1C deenergizing the warp switch heater 17 and the igniter 13, and closing contacts R1B which permits the main valve 12 to be energized to supply fuel to the main burner for ignition by the pilot flame.

When the warp switch heater 17 is deenergized and begins to cool, element 43 (FIG. 2) moves contact 51 out of engagement with contact 53 opening contacts WS1. However, the main valve 12 and the pilot valve 11 remain energized over contacts R2A of relay R2. The cooling of the warp switch heater 17 also maintains the contacts WS2 of the warp switch closed thereby maintaining the energizing circuit for the pilot valve 11 and the main valve 12.

When the contacts THS are opened when the heating demand has been met, the pilot valve 11, the main valve 12, relay R2 and the flame sensing circuit 14 are deenergized, and the system is prepared for the next heating cycle.

If pilot ignition has not occurred within a predetermined time, on the order of 30 seconds following closure of contacts THS, the warp switch heater 17 heats element 42 (FIG. 2) sufficiently to move contact 51 out of engagement with contact 52 to open contacts WS2, interrupting the energizing circuit for the flame sensing circuit 14 and for the pilot valve 11, cutting off the supply of fuel to the pilot outlet, and the system remains in a lockout condition until contacts THS are opened. When contacts THS are opened, the warp switch heater 17 is deenergized, and after a predetermined cooling time, permits contacts WS2 to reclose and the system is prepared for a further trial for ignition.

In the event of a failure condition wherein the contacts R2B, which control the main valve 12, become welded together following a successful start up, then at the end of the heat run, when contacts THS open, the pilot valve 11, the main valve 12 and the flame sensing circuit 14 are deenergized. However, when the flame sensing circuit 14 deenergizes relay R1, contacts R1A cannot reclose since contacts R1 are welded together. Accordingly, when contacts THS close in response to the next call for heat, contacts R1A, which are connected in series with heater element 17 of the warp switch WS, are maintained open, preventing energization of the heater element 17. Thus, the contacts WS1 remain open, preventing the energization of the pilot valve 11 and the flame sensing circuit 14.

Thus, in the system 10, shown in FIG. 1, the warp switch WS and relay R2 provide contact interlock protection, and the warp switch WS provides 100% shut off of fuel supply in the event a pilot flame is not established within a predetermined time, on the order to 30 seconds, following closure of contacts THS. Accordingly, fuel accummulation is prevented, particularly when the fuel is a heavier than air gas, such as propane, butane, etc. In addition, the warp switch WS also prevents energization of the pilot valve 11 and the main valve 12 for a failure condition of the flame relay R1.

It is pointed out that the system 10 will also be locked out in the event of a leak condition for the pilot valve 11. For the condition where the pilot valve seat develops a leak large enough to support flame at the pilot outlet, then when contacts THS open, to deenergize the system 10, the pilot flame will remain established. On the next call for heat, the presence of the pilot flame is detected by the flame sensing circuit 14 such that relay R1 is energized, opening contacts R1A before the warp switch WS operates to energize relay R2, causing the system 10 to be locked out.

Figure 3:
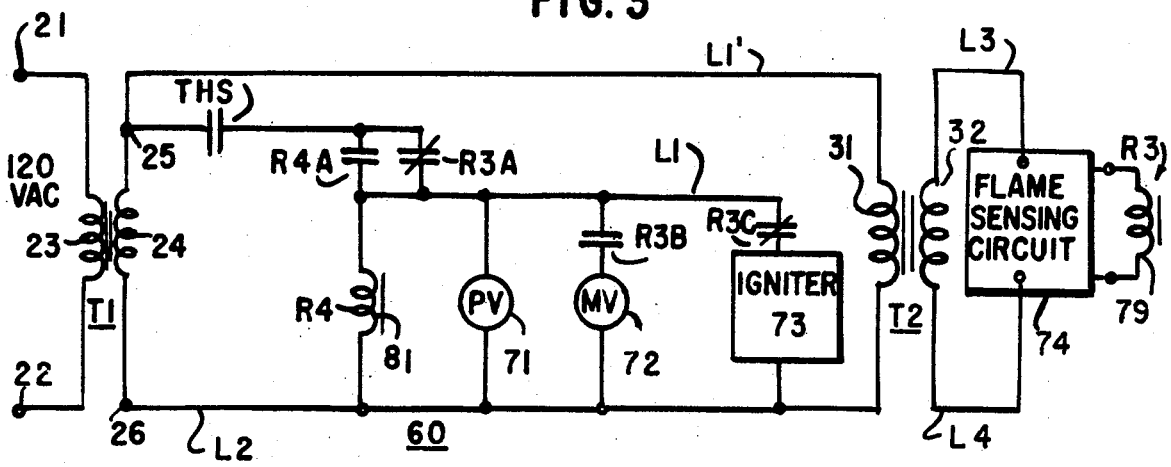
FIG. 3 is a schematic circuit diagram of a fuel ignition system including a control arrangement provided in accordance with a second embodiment of the invention; and, FIG. 4 is a schematic circuit diagram of a fuel ignition system including a control arrangement provided in accordance with a third embodiment of the invention.

Referring to FIG. 3, there is shown a simplified representation of a fuel ignition system 60 which includes a control arrangement provided in accordance with a further embodiment of the invention. The system 60 includes a pilot valve 71, a main valve 72, an igniter 73, and a flame sensing circuit 74, including a DPDT relay R3, which is similar to relay R1 (FIG. 1) and having normally closed contacts R3A, which are connected in an energizing path for the pilot valve 71, and normally open contacts R3B, which are connected in an energizing path for the main valve 72, employing a common armature of the relay R3.

In the embodiment shown in FIG. 3, a relay R4 provides an interlock function to prevent start up if for any reason the normally closed contacts R3A of the relay R3 are open for a start up condition. Such condition may occur due to a failure in the flame sensing circuit, which permits relay R3 to be maintained energized, or in the case that contacts R3B, which control the energization of the main valve 72, become welded together such that when relay R3 is deenergized, contacts R3A cannot reclose.

The energizing path for the pilot valve 71 and the main valve 72 is provided over normally closed contacts R3A of the sensing relay R3. A holding path is provided by contacts R4A of the interlock relay R4 when the relay R3 operates to open contacts R3A. Failure of relay R4 to operate prior to operation of relay R3 results in the shut down of the system.

In the embodiment shown in FIG. 3, power is supplied to the flame sensing circuit 74 directly from the input transformer T1 whereas relay R4 and the pilot valve 71 are energized over the thermostatically controlled contacts THS to assure that relay R3 operates before relay R4 for a failure condition. Alternatively, the flame sensing circuit may be energized over the contact THS by using a slow to operate relay, having an operate time on the order of one minute for relay R4, to assure that for a failure condition the sensing relay R3 is operated when power is applied to relay R4.

Considering the circuit of FIG. 3 in more detail, in the illustrated embodiment, power is supplied to the system 60 over an input transformer T1 which has a primary winding 23 connected to input terminals 21 and 22 which are connectable to a 120VAC source, and a secondary winding 24 connected to provide 25 VAC to terminals 25 and 26.

The flame sensing circuit 74, which may be the flame sensing circuit disclosed in U.S. Pat. No. 3,902,839, is energized over a transformer T2 which has a primary winding 31 having one end connected over a conductor L1′ to terminal 25 and its other end connected over a conductor L2 to terminal 26. The secondary winding 32 of transformer T2 is connected over conductors L3 and L4 to inputs of the flame sensing circuit 74.

The pilot valve 71 is connected between a conductor L2 and a conductor L1 which is connected over normally closed contacts R3A of relay R3 and thermostatically controlled contacts THS to input terminal 25. The main valve 72 is connected between conductors L1 and L2 in series with normally open contacts R3B of relay R3, and the igniter 73 is connected between conductors L1 and L2 over normally closed contacts R3C of relay R3 of the flame sensing circuit 74. The operate coil 81 of relay R4 is connected between conductors L1 and L2 and has normally open contacts R4A connected in shunt with contacts R3A of relay R3 between conductor L1 and contacts THS to permit power to be supplied to conductors L1 and L2 when relay R3 operates to open contacts R3A.

In operation, when power is applied to input terminals 21 and 22, 25 VAC is provided between conductors L1′ and L2, energizing the flame sensing circuit 74. In response to the closure of thermostatically controlled contacts THS, conductor L1 is connected to conductor L1′ over contacts THS and R3A of relay R3 to energize the pilot valve 71 and the igniter 73. When the pilot valve 71 is energized, fuel is supplied to a pilot outlet for ignition by ignition sparks provided by the igniter 73.

In addition, relay R4 operates to close contacts R4A to establish a holding path for the igniter circuit 73, the relay R4 and the pilot valve 71.

The flame sensing circuit 74, which is normally energized, responds to the pilot flame to effect the energization of the operate coil 79 of relay R3 which operates to close contacts R3, which are connected in series with the main valve 72 between conductors L1 and L2, permitting the main valve 72 to operate to supply fuel to a main burner apparatus for ignition by the pilot flame. In addition, normally closed contacts R3C are opened to deenergize the igniter 73, and normally closed contacts R3 are opened, interrupting the energizing path for relay R4 and the pilot valve 71 which are maintained energized over contacts R4A of relay R4.

When the heating demand has been met and contacts THS open, relay R4 is deenergized, along with the pilot valve 71 and the main valve 72, extinguishing the flame at the pilot outlet and main burner. The flame sensing circuit 74 responds to the loss of flame to deenergize relay R3 which opens contacts R3B to interrupt the energizing path for the main valve 72 and to close contacts R3A and R3C, and the system 60 is prepared for the next heating cycle.

In the event of a failure condition following a successful start up, such as the welding together of the contacts R3B which control the operation of the main valve 72, then when the heating demand has been met, and contacts THS open, the pilot valve 71 and the main valve 72 are deenergized, extinguishing the flame. The flame sensing circuit 74 responds to the loss of flame to deenergize relay R3. However, since contacts R3B are welded together, contacts R3A cannot reclose. Accordingly, when contacts THS close on the next call for heat, the energizing path for the pilot valve 71 is interrupted causing the pilot valve 71 and the main valve 72 to be maintained in a lock out condition.

In the event of a failure in the flame sensing circuit 74 which permits relay R3 to remain operated in the absence of a flame, or for the condition where the pilot valve seat develops a leak large enough to support a flame at the pilot outlet so that relay R3 is maintained energized, when contacts THS open, contacts R3A are maintained open such that when contacts THS close in response to the next call for heat, the energizing path for the relay R4 and the pilot valve 71 is interrupted, preventing operation of the pilot valve 71 and the system is maintained in a lock out condition.

Figure 4:
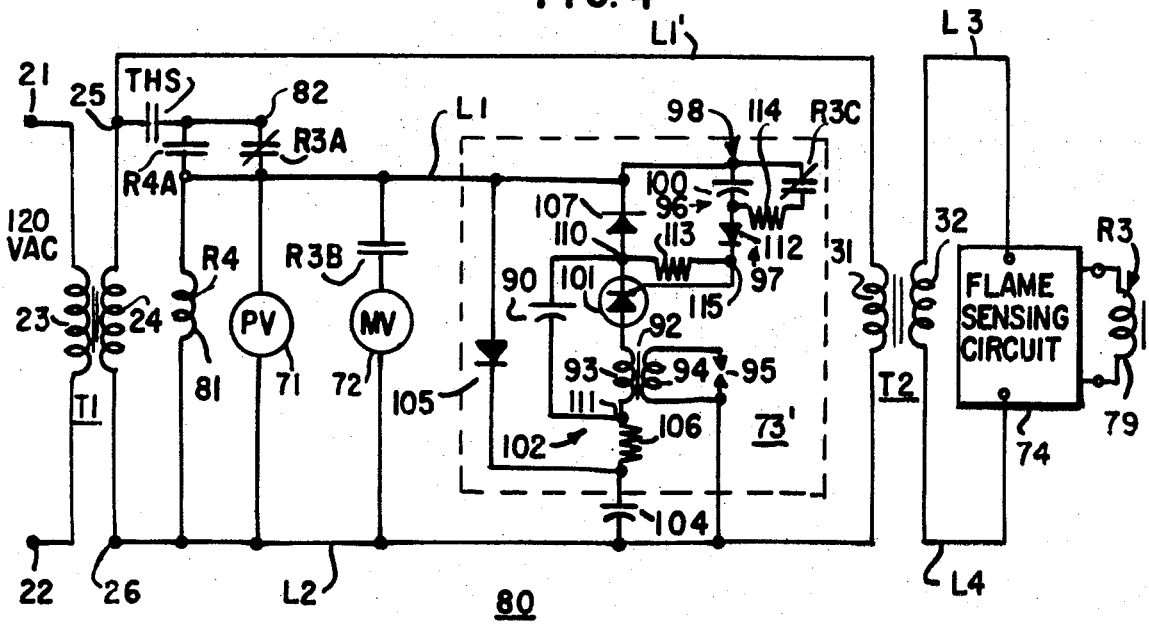

Referring to FIG. 4, there is shown a fuel ignition system 80, including a further embodiment for a control arrangement provided in accordance with the present invention. The system 80 is generally similar to the system 60 shown in FIG. 3, and accordingly, corresponding elements have been given like reference numbers.

The system 80 includes a flame sensing circuit 74, including a relay R3, a pilot valve 71, which is connected between conductors L1 and L2, a main valve 72, which is connected between conductors L1 and L2 over normally open contacts R3B of relay R3, and an igniter 73′ which is connected between conductors L1 and L2 over normally closed contacts R3 of relay R3. An interlock relay R4, having an operate coil 81 connected between conductors L1 and L2, has normally open contacts R4A connected in shunt with contacts R3A.

Conductor L1 is connected over normally closed contacts R3A of relay R3 and normally open thermostatically controlled contacts THS to one terminal 25 of the secondary winding 24 of a step-down transformer T1, and conductor L2 is connected to a second terminal 26 of winding 24. The input transformer has a primary winding 23 connectable to a source of 120 VAC, and the secondary winding 24 provides 25 VAC between terminals 25 and 26.

The flame sensing circuit 74 is energized over transformer T2 which has a primary winding 31 connected to conductors L1′ and L2, and a secondary winding 32 is connected to input terminals of the flame sensing circuit 74.

In the system 80, shown in FIG. 4, conductor L1′ is connected to the input terminal 25 so that the flame sensing circuit 74 is energized directly from the input transformer T1 in the manner illustrated for the system 60 shown in FIG. 3. Also, in the system 80 the igniter circuit 73′, which is controlled by relay R3 of the flame sensing circuit 74, provides a lingering spark following operation of the relay R3 in a manner to be described.

Referring to the igniter circuit 73′, the igniter circuit is of the capacitive discharge type and includes a capacitor 90 which is charged and then discharged over the primary winding 93 of an ignition transformer 92, during alternate half cycles of the AC line signal to provide sparks over a pair of ignition electrodes 95 which are connected to the secondary winding 94 of the ignition transformer 92. The capacitor 90 is charged during one half cycle of the AC line signal and during the next half cycle begins to discharge over one of two current paths 96 or 97 one of which includes a timing network 98, including a capacitor 100 and the other of which includes normally closed contacts R3C of the relay R3, which are connected in shunt with capacitor 100. Accordingly, as long as relay R3 is deenergized, the capacitor 100 is effectively short circuited and the capacitor 90 is permitted to charge and discharge indefinitely to activate the electrodes 95, providing ignition sparks. When relay R3 is energized, contacts R3C are opened, interrupting the current path 97 and the discharge of the capacitor 90 is initiated over the other current path 96, including capacitor 100. For such condition, the charging and discharging of capacitor 90 continues until the capacitor 100 is charged after which time the igniter 73′ is disabled.

In response to capacitor discharge current flow over either one of the current paths 96 or 97, a controlled switching device, embodied as a silicon controlled rectifier 101, is enabled, providing a discharge path for the capacitor 90 over the primary winding 93 of the ignition transformer 92 inducing a voltage in the secondary winding 94 which is applied to the electrodes 95, causing a spark to be generated.

More specifically, the igniter 73′ includes a voltage doubler circuit 102, including a capacitor 104 which supplies a voltage to capacitor 90, enabling capacitor 90 to be charged to approximately twice the line voltage. Capacitor 104 has a charging path which extends from conductor L1 over a diode 105 and the capacitor 104 to conductor L2. Capacitor 104 is charged when conductor L1 is positive relative to conductor L2 during positive half cycles of the AC line signal.

Capacitor 90 charges during negative half cycles of the AC line signal, that is when conductor L2 is positive relative to conductor L1, over a path which extends from line L2 to one side of capacitor 90 at point 111 over capacitor 104 and a resistor 106, and from the other side of capacitor 90 at point 110, over a diode 107 to conductor L1.

The SCR device 101 has its anode connected to conductor L2 over the primary winding 93 of the transformer 92, resistor 106, and capacitor 104, and its cathode connected to conductor L1 over diode 107. The current paths 96 and 97, provide a gate control circuit for the SCR device 101. The current path 96 includes capacitor 100, a diode 112 and a resistor 113 which are connected in series between line L1 and point 110. The other current path 97 includes normally closed contacts R3A of relay R3, a resistor 114, diode 112 and resistor 113 which are connected between line L1 and point 110, contacts R3A and resistor 114 being connected in shunt with capacitor 100.

The gate of the SCR device 101 is connected to the junction of the cathode of diode 112 and resistor 113 at point 115 and is rendered conductive whenever the potential at point 115 exceeds the gate threshold of the SCR device 101.

In operation, when thermostatically controlled contacts THS close in response to a request for heat, power at 25 VAC is applied to conductors L1 and L2 over contacts THS and normally closed contacts R3A of relay R3 to energize the pilot valve 71 and the igniter 73'. When the pilot valve 71 is energized, fuel is supplied to a pilot outlet for ignition by ignition sparks provided by the igniter 73'. In addition, relay R4 operates to close contacts R4A to provide a holding path for the relay R4, the pilot valve 71, and the igniter circuit 73'.

With reference to the igniter circuit 73', when line L1 is positive relative to line L2, capacitor 104 is charged over diode 105 to a voltage of approximately 35 volts. When line L2 becomes positive relative to line L1 during the next negative half cycle of the AC line signal, capacitor 90 is charged over capacitor 104, resistor 106 diode 107, with the charge on capacitor 104 being transferred to capacitor 90, such that capacitor 90 is charged to approximately 70 volts. During the next half cycle, when line L1 is again positive relative to line L2 and the AC signal begins to decrease from its maximum value, the voltage on capacitor 90 is greater than the supply voltage, permitting current to flow from the positive side of the capacitor 90 at point 111 through resistor 106, capacitor 104, the secondary winding 24 of the input transformer T1, and over current path 97, including normally closed contacts R3A of relay R3, resistor 114, diode 112 and resistor 113, to the negative side of the capacitor 90 at point 110, establishing a positive voltage at point 115 which is connected to the gate of SCR 101 which then conducts.

Capacitor 90 discharges over the primary winding 93 of the ignition transformer 92 and the anode to cathode circuit of the SCR device 101, inducing a voltage in the secondary winding 94 of the ignition transformer 92, activating the electrodes 95 to generate an ignition spark. The igniter circuit 73' continues to operate in the manner described above, providing ignition sparks until the fuel supplied to the pilot outlet is ignited.

The flame sensing circuit 74, responds to the pilot flame to effect the energization of the operate coil 79 of relay R3 which operates to close contacts R3B, which are connected in series with the main valve 72 between conductors L1 and L2, permitting the main valve 72 to operate to supply fuel to the main burner apparatus for ignition by the pilot flame. In addition, normally closed contacts R3C are opened to disable the igniter circuit 73', and normally closed contacts R3A are opened, interrupting the energizing path for relay R4, the pilot valve 71 and the igniter circuit 73' which are maintained energized over contacts R4A of relay R4.

Digressing, under normal conditions, relay R3 is maintained deenergized until a pilot flame is established at which time the relay R3 is energized to operate the main valve 72 and disable the igniter circuit 73' as described above. In the event of a failure condition following a successful start up, such a change in the circuit characteristic of the flame sensing circuit 16 causing the relay K1 to energize without pilot flame followed by a line voltage interruption, then, when power is restored, relay K2 will energize before relay K1, as in a normal start up, and relay K1 will energize without pilot flame because of the fault. When relay K1 operates, contacts K1C open to disable the igniter 73'. However, the igniter continues to provide sparks to ignite the fuel supplied to the pilot outlet and the main burner to provide heat to complete the heating cycle causing the THS contacts to open. On the next call for heat, the control circuit and fuel valves are locked out and will not start up because of the circuit fault which maintains relay K1 operated.

When contacts R3C open, current path 97 is interruped. However, capacitor 90 continues to be charged and begins to discharge over the current path 96, including timing capacitor 100. That is, when the voltage on capacitor 90 becomes greater than the supply voltage during the positive half cycles of the AC line signal, current flows from the positive side of capacitor 90 at point 111 through resistor 106, capacitor 104, the secondary winding 24 of the input transformer T1, capacitor 100, diode 112 and resistor 113 to the negative side of capacitor 90 at point 110, providing a turn-on voltage at point 115 for the SCR device 101, permitting capacitor 90 to be discharged over the primary winding 93 of the ignition transformer 92, causing ignition sparks to be generated. The sparking continues until the timing capacitor 100 becomes fully charged at which time current flow ceases and the potential at point 115 drops to zero. Accordingly, the SCR device 101 is not triggered and further spark generation is inhibited. In one embodiment in which the value of the timing capacitor was 0.22 microfarads, and resistors 113 and 106 were 1K ohms and 680 ohms, respectively, the igniter circuit 73' was maintained operable to provide ignition sparks for a period of 10 seconds following the operation of relay R3. It should be noted that long time delays can be achieved using low values for the timing capacitor 100 because the capacitor charging current is of a very short duration, typically on the order of 7 microseconds.

Thus, for a failure condition of the type noted above, the igniter circuit 73' remains operative to provide ignition sparks for the time after operation of relay R3, for igniting fuel supplied to the pilot outlet and the main burner apparatus.

When the heating demand has been met and contacts THS open, relay R4 is deenergized, along with the pilot valve 71 and the main valve 72, extinguishing the flame at the pilot outlet and the main burner. The flame sensing circuit 74 responds to the loss of flame to denergize relay R3 which opens contacts R3B to interrupt the energizing path for the main valve 72 and to close contacts R3A and R3C, and the system 80 is prepared for the next heating cycle.

In the event of a failure condition following a successful start up, such as the welding together of the contacts R3B which control the operation of the main valve 72, then when the heating demand has been met, and contacts THS open, the pilot valve 71 and the main valve 72 are deenergized, extinguishing the flame. The flame sensing circuit 74 responds to the loss of flame to deenergize relay R3. However, since contacts R3B are welded together, contacts R3A cannot reclose. Accordingly, when contacts THS close on the next call for heat, the energizing path for the pilot valve 71 is interrupted causing the pilot valve 71 and the main valve 72 to be maintained in a lockout condition.

In the event of a failure in the flame sensing circuit 74 which permits relay R3 to remain operated in the absence of a flame, or for the condition where the pilot valve seat develops a leak large enough to support a flame at the pilot outlet so that relay R3 is maintained energized when contacts THS open, contacts R3A are maintained open. Accordingly, when contacts THS close in response to the next call for heat, the energizing path for the relay R4 and the pilot valve 71 is interrupted, preventing operation of the pilot valve 71, and the system 80 is maintained in a lock out condition.

I claim:

1. In a fuel ignition system including pilot valve means operable when energized to supply fuel to a pilot outlet for ignition by an igniter means to establish a pilot flame, and main valve means operable when energized to supply fuel to a main burner apparatus for ignition by the pilot flame, a control arrangement comprising control means including first switching means, second switching means operable when enabled to provide an energizing path for said first switching means and said pilot valve means to effect energization of said pilot valve means, permitting fuel to be supplied to said pilot outlet, activate means responsive to a demand for heat to enable said second switching means to provide said energizing path to energize said first switching means and said pilot valve means, said first switching means being operable when energized to provide a holding path for said pilot valve means and said first switching means, said control means further including flame sensing means responsive to the establishment of a pilot flame for connecting said main valve means to said holding path to effect energization of said main valve means, permitting fuel to be supplied to said main burner apparatus, and for causing said energizing path to be interrupted whereby said first switching means, said pilot valve means and said main valve means are maintained energized over said holding path, said activate means being operable when the demand for heat has been met to interrupt said holding path to thereby deenergize said pilot valve means and said main valve means.

2. A system as set forth in claim 1 wherein said second switching means is operable to interrupt said holding path at a predetermined time following the occurrence of said demand for heat, said flame sensing means overriding said second switching means to prevent the interruption of said holding path whenever a pilot flame is established within said predetermined time.

3. A system as set forth in claim 2 wherein said flame sensing means includes third switching means having first contacts connected in an energizing path for said main valve means and second contacts connected in an energizing path for said second switching means, said third switching means being enabled to operate said first and second contacts to effect the energization of said main valve means and the deenergization of said second switching means when a pilot flame is established, said second switching means being prevented from responding to said activate means whenever said second contacts are open.

4. In a fuel ignition system including pilot valve means operable when energized to supply fuel to a pilot outlet for ignition by an igniter means to establish a pilot flame, and main valve means operable when energized to supply fuel to a main burner apparatus for ignition by the pilot flame, a control arrangement comprising control means for providing an energizing path for said pilot valve means to effect energization of said pilot valve means, permitting fuel to be supplied to said pilot outlet, said control means including first switching means having slow-to-operate switch means connected to said energizing path, activate means responsive to a demand for heat to effect energization of said pilot valve means and said switch means over said energizing path, said switch means being operable when energized to close first contacts to provide a holding path for said pilot valve means and said switch means, said control means further including flame sensing means which includes second switching means having second contacts connected in said energizing path to permit said switch means and said pilot valve means to respond to said activate means whenever said second contacts are closed and to prevent said switch means and said pilot valve means from responding to said activate means whenever said second contacts are open, said second switching means being enabled in response to the establishment of a pilot flame to close third contacts for connecting said main valve means to said holding path to effect energization of said main valve means, permitting fuel to be supplied to said main burner apparatus and to open said second contacts to interrupt said energizing path whereby said switch means, said pilot valve means and said main valve means are maintained energized over said holding path, said activate means being operable when the demand for heat has been met to interrupt said holding path to thereby deenergize said switch means, said pilot valve means and said main valve means.

5. A system as set forth in claim 4 wherein said activate means includes normally open thermostatically controlled contacts operable to connect said energizing path to a source of energizing potential, said flame sensing means being connectable to said source of energizing potential over said thermostatically controlled contacts.

6. A system as set forth in claim 5 wherein said switch means comprises a slow-to-operate relay.

7. In a fuel ignition system including pilot valve means operable when energized to supply fuel to a pilot outlet for ignition by an igniter to establish a pilot flame, and main valve means operable when energized to supply fuel to a main burner apparatus for ignition by the pilot flame, a control arrangement comprising first switching means, activate means responsive to a demand for heat to energize said first switching means to prepare an energizing path for said pilot valve means, second switching means responsive to said first switching means to complete said energizing path for said pilot valve means to effect energization of said pilot valve means, permitting fuel to be supplied to said pilot outlet, and to provide a holding path for said pilot valve means, and flame sensing means including third switching means enabled responsive to the establishment of a pilot flame to connect said main valve means to said holding path to effect energization of said main valve means, permitting fuel to be supplied to said main burner apparatus, and to deenergize said first switching means for interrupting said energizing path, said pilot valve means and said main valve means being maintained energized over said holding path when said first switching means is deenergized, and said activate means being operable when the demand for heat has been met to interrupt said holding path to thereby deenergize said pilot valve means and said main valve means.

8. A system as set forth in claim 7 wherein said first switching means has normally open contacts connected in said energizing path, and operate means energized in response to said activate means to cause said contacts to close to complete said energizing path.

9. In a fuel ignition system including pilot valve means operable when energized to supply fuel to a pilot outlet for ignition by an igniter to establish a pilot flame, and main valve means operable when energized to supply fuel to a main burner apparatus for ignition by the pilot flame, a control arrangement comprising first switching means, second switching means, activate means responsive to a demand for heat to energize said first switching means, said first switching means having normally open contacts connected in an energizing path for said second switching means, and operate means energized by said activate means to cause said contacts to close to complete said energized path for said second switching means, said second switching means being operable when energized to connect said pilot valve means to said energizing path to effect energization of said pilot valve means, permitting fuel to be supplied to said pilot outlet, and to provide a holding path for said pilot valve means, and flame sensing means responsive to the establishment of a pilot flame to connect said main valve means to said holding path to effect energization of said main valve means, permitting fuel to be supplied to said main burner apparatus and to deenergize said first switching means for interrupting said energizing path, said pilot valve means and said main valve means being maintained energized over said holding path when said first switching means is deenergized, said first switching means having normally closed contacts connected in said energizing path and said holding path, said operate means causing said normally closed contacts to open whenever said first switching means remains energized at a predetermined time following the occurrence of said demand for heat to interrupt said energizing path and said holding path to thereby deenergize said pilot valve means and said second switching means, said flame sensing means deenergizing said first switching means when a pilot flame is established within a predetermined time to maintain said pilot valve means and said main valve means energized, and said activate means being operable when the demand for heat has been met to interrupt said holding path to thereby deenergize said pilot valve means and said main valve means.

10. A system as set forth in claim 9 wherein said first switching means comprises a warp switch having a single heating element which controls the operation of said normally open contacts and said normally closed contacts.

11. A system as set forth in claim 9 wherein said first switching means comprises a first warp switch having a first heating element which controls said normally open contacts, and a second warp switch having a second heating element which controls the operation of said normally closed contacts.

12. In a fuel ignition system including pilot valve means operable when energized to supply fuel to a pilot outlet for ignition by an igniter to establish a pilot flame, and main valve means operable when energized to supply fuel to a main burner appratus for ignition by the pilot flame, a control arrangement comprising first switching means, activate means responsive to a demand for heat to energize said first switching means to prepare an energizing path for said pilot valve means, second switching means responsive to said first switching means to complete said energizing path for said pilot valve means to effect energization of said pilot valve means, permitting fuel to be supplied to said pilot outlet, and to provide a holding path for said pilot valve means, and flame sensing means including a normally deenergized relay having first normally open contacts connected in an energizing path for said main valve means and second normally closed contacts connected in an energizing path for said first switching means, said relay being energized when a pilot flame is established and being operable when energized to close said first contacts to connect said main valve means to said holding path to effect the energization of said main valve means permitting fuel to be supplied to said main burner and to open said second contacts to cause deenergization of said first switching means for interrupting said energizing path for said pilot valve means whereby said pilot valve means and said main valve means are maintained energized over said holding path when a pilot flame is established, said first switching means being prevented from being energized by said activate means whenever said second contacts are open, and said activate means being operable when the demand for heat has been met to interrupt said holding path to thereby deenergize said pilot valve means and said main valve means.

13. A system as set forth in claim 12 wherein said second switching means comprises a relay connected to said energizing path for said pilot valve means and having normally open contacts connected in shunt with said first contacts to complete said holding path.

14. In a fuel ignition system including pilot valve means operable when energized to supply fuel to a pilot outlet for ignition by an igniter means to establish a pilot flame, and main valve means operable when energized to supply fuel to a main burner apparatus for ignition by the pilot flame, a control arrangement comprising first switching means operable when energized to close first contacts to prepare an energizing path for said pilot valve means, activate means operable in response to a demand for heat to effect energization of said first switching means, second switching means energized in response to the closing of said first contacts to close second contacts to complete said energizing path for said pilot valve means, to effect energization of said pilot valve means, permitting fuel to be supplied to said pilot outlet, and to close third contacts to provide a shunt path around said first contacts, providing a holding path for said pilot valve means, flame sensing means including third switching means energized in response to the establishment of a pilot flame to close fourth contacts to connect said main valve means to said holding path to effect energization of said main valve means, permitting fuel to be supplied to said main burner and to open fifth contacts to deenergize said first switching means to cause said first contacts to open to interrupt said energizing path whereby said pilot valve means and said main valve means are maintained energized over said holding path, said first switching means being prevented from responding to said activate means to maintain said pilot valve means and said main valve means deenergized whenever said fifth contacts are open at the time of occurrence of said demand for heat.

15. A system as set forth in claim 14 wherein said first switching means is operable to open sixth contacts to interrupt said energizing path and said holding path when a pilot flame fails to be established within a predetermined time following the energization of said first switching means.

16. In a fuel ignition system including pilot valve means operable when energized to supply fuel to a pilot outlet for ignition by an igniter means to establish a pilot flame, and main valve means operable when energized to supply fuel to a main burner apparatus for ignition by the pilot flame, a control arrangement comprising activate means responsive to a demand for heat to complete an energizing path for said pilot valve means to effect the energization of said pilot valve means, permitting fuel to be supplied to said pilot outlet, interlock means including first normally disabled switching means connected to said energizing path to be enabled over said energizing path in response to said activate means to provide a holding path for said pilot valve means, and flame sensing means energized continuously and independently of said activate means to be responsive to the establishment of a pilot flame to effect the connection of said main valve means to said holding path for energization, and to interrupt said energizing path whereby said pilot valve means and said main valve means are maintained energized over said holding path, said flame sensing means including second switching means having first contacts connected in said energizing path to permit said first switching means and said pilot valve means to respond to said activate means whenever said first contacts are closed and to prevent said first switching means and said pilot valve means from responding to said activate means whenever said first contacts are open, said activate means being operable when the demand for heat has been met to interrupt said holding path thereby to deenergize said pilot valve means and said main valve means.

17. A system as set forth in claim 16 wherein said first switching means has second normally open contacts connected in shunt with said first contacts, said first switching means being operable when enabled to close said second contacts to provide said holding path.

18. A system as set forth in claim 16 wherein said second switching means has third normally open contacts operable to contact said main valve means to said holding path, said second switching means being enabled when a pilot flame is established to open said first contacts to interrupt said energizing path and to close said third contacts, permitting said main valve means to be energized over said holding path, said second switching means being disabled to close said first contacts and to open said third contacts when the demand for heat has been met, said third contacts preventing the reclosure of said first contacts in the event that said third contacts become welded together.

19. A system as set forth in claim 16 wherein said activate means includes normally open thermostatically controlled contacts operable to connect said energizing path to a source of energizing potential, said flame sensing means being connected directly to said source of energizing potential.

20. A system as set forth in claim 16 wherein said second switching means prevents said energizing path from being completed whenever a flame is established at said pilot outlet prior to operation of said activate means.

21. A system as set forth in claim 16 wherein said second switching means maintains said energizing path interrupted following the operation of said activate means when the demand for heat has been met to thereby prevent energization of said pilot valve means and said main valve means in response to a subsequent request for heat in the event of a leak condition for said pilot valve means which permits a pilot flame to be maintained at said pilot outlet in the absence of a request for heat.

22. In a fuel ignition system including pilot valve means operable when energized to supply fuel to a pilot outlet for ignition by an igniter means to establish a pilot flame, and main valve means operable when energized to supply fuel to a main burner apparatus for ignition by the pilot flame, a control arrangement comprising flame sensing means including a flame sensing circuit and first switching means having first normally closed contacts, activate means operable in response to a demand for heat to provide an energizing path over said first contacts for said pilot valve means to effect energization of said pilot valve means, permitting fuel to be supplied to said pilot outlet, second switching means connected to said energizing path to be energized over said first contacts in response to said activate means, whenever said first contacts are closed, to close second contacts to provide a shunt path around said first contacts, providing a holding path for said pilot valve means, said flame sensing circuit being energized continuously and independently of said activate means to permit said first switching means to be energized in response to the establishment of a pilot flame to close third contacts to connect said main valve means to said holding path to effect energization of said main valve means, permitting fuel to be supplied to said main burner apparatus, and to open said first contacts to interrupt said energizing path whereby said second switching means, said pilot valve means and said main valve means are maintained energized over said holding path, said second switching means being prevented from responding to said activate means whenever said first contacts are open at the time of occurrence of said demand for heat.

* * * * *

UNITED STATES PATENT AND TRADEMARK OFFICE

CERTIFICATE OF CORRECTION

PATENT NO. : 4,077,762

DATED : March 7, 1978

INVENTOR(S) : Russell Byron Matthews

It is certified that error appears in the above-identified patent and that said Letters Patent are hereby corrected as shown below:

Column 15, line 36, "energized" should be "energizing"; and

Column 16, line 14, "appratus" should be "apparatus".

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*